US007104818B1

(12) United States Patent
Chang

(10) Patent No.: US 7,104,818 B1
(45) Date of Patent: Sep. 12, 2006

(54) RECEPTACLE STRUCTURE

(76) Inventor: Chi-Tsai Chang, No. 39, Sec. 3, Han Kou Rd., Taichung City (TW)

( * ) Notice: Subject to any disclaimer, the term of this patent is extended or adjusted under 35 U.S.C. 154(b) by 0 days.

(21) Appl. No.: 11/225,155

(22) Filed: Sep. 14, 2005

(51) Int. Cl.
*H01R 13/44* (2006.01)

(52) U.S. Cl. ..... 439/140; 439/137

(58) Field of Classification Search ..... 439/137, 439/140, 353
See application file for complete search history.

(56) References Cited

U.S. PATENT DOCUMENTS 4,109,989 A * 8/1978 Snyder et al. ..... 439/140
5,178,552 A * 1/1993 Jinno et al. ..... 439/140
6,176,712 B1 * 1/2001 Huang ..... 439/140

* cited by examiner

*Primary Examiner*—Truc Nguyen
(74) *Attorney, Agent, or Firm*—Leong C. Lei

(57) ABSTRACT

An electrical receptacle is provided herein which has a special locking mechanism preventing the plug from falling off. The receptacle mainly contains a body housed inside a sleeve. The body has at least a locking blade with a bended portion extended out of the body and pressed against the inside of the sleeve. A slot opening on the bended portion is roughly aligned with the slot of the body. When the prong of a plug is inserted into the sleeve, the sleeve presses the bended portion so that the slot opening and the slot on the body are completely aligned and the prong could go all the way into the slot of the body. The bended portion of the locking blade then springs back to a slant position to lock the prong. To unplug, the pulling force applied to the plug drags the body toward the sleeve which again presses the bended portion of the locking blade so that the prong could be pulled out of the slot of the body easily.

9 Claims, 6 Drawing Sheets

RECEPTACLE STRUCTURE

BACKGROUND OF THE INVENTION (a) Technical Field of the Invention

The present invention generally relates to electrical receptacles and, more particularly, to a receptacle structure having a locking mechanism to prevent from the plug from falling off.

(b) Description of the Prior Art

Traditional electrical receptacle relies on the electrical conducting blades installed inside the receptacle to clip the prongs of a plug. Usually after period of usage, the clipping force of the electrical conducting blades is weaken and therefore the receptacle cannot hold the prongs reliably, and some slight impact could knock the plug off the receptacle easily, causing sudden interruption to the supply of electricity. When this happens, the electrical appliance could be damaged or some vital data is lost. To solve the problem, people usually force the prongs to spread farther apart so that they could establish tighter contact with the electrical conducting blades. However, this brute-force approach may destroy the plug or further diminish the clipping force of the electrical conducting blade.

SUMMARY OF THE INVENTION

The primary purpose of the present invention is to provide a receptacle having a built-in locking mechanism is provided herein to mitigate the unreliable connection problem of conventional plugs and receptacles.

The receptacle according to the present invention mainly contains a body housed inside a sleeve where the body could slightly move back and forth inside the sleeve. The body of the receptacle has at least a locking blade with a bended portion extended out of the body and pressed against the inside of sleeve. A slot opening on the bended portion is roughly aligned with the slot of the body. When the prong of a plug is inserted into the sleeve, the sleeve presses the bended portion of the locking blade so that the slot opening and the slot on the body are completely aligned and the prong could go all the way into the slot of the body. The bended portion of the locking blade then springs back to a slant position to lock the prong. To unplug, a user holds the sleeve while pulling the plug. The pulling force drags the body toward the sleeve which again presses the bended portion of the locking blade so that the slot opening and the slot on the body are completely aligned and the prong could be pulled out of the slot of the body easily.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
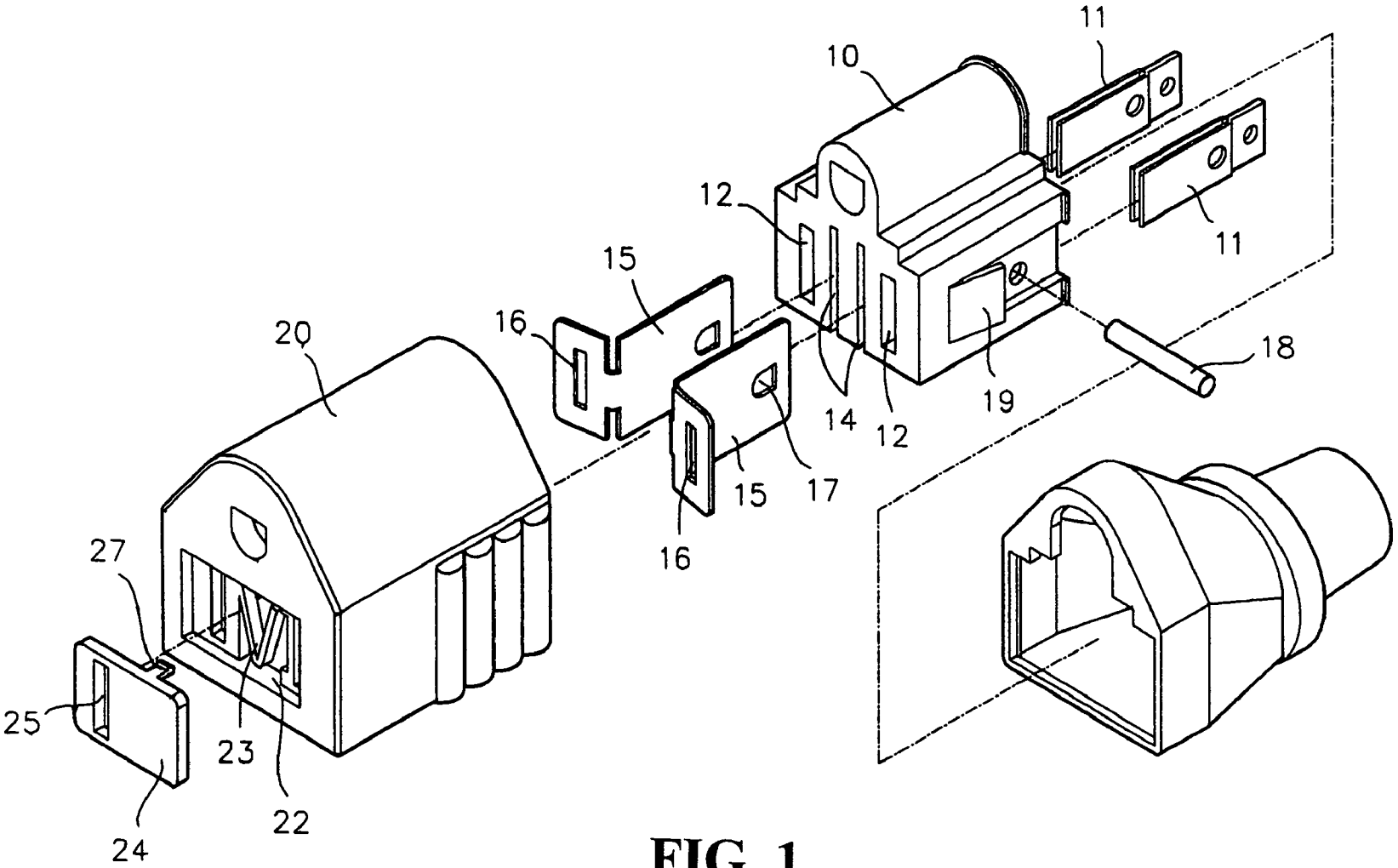
FIG. 1 is a perspective view showing the various components of a receptacle according to an embodiment the present invention.
Figure 2:
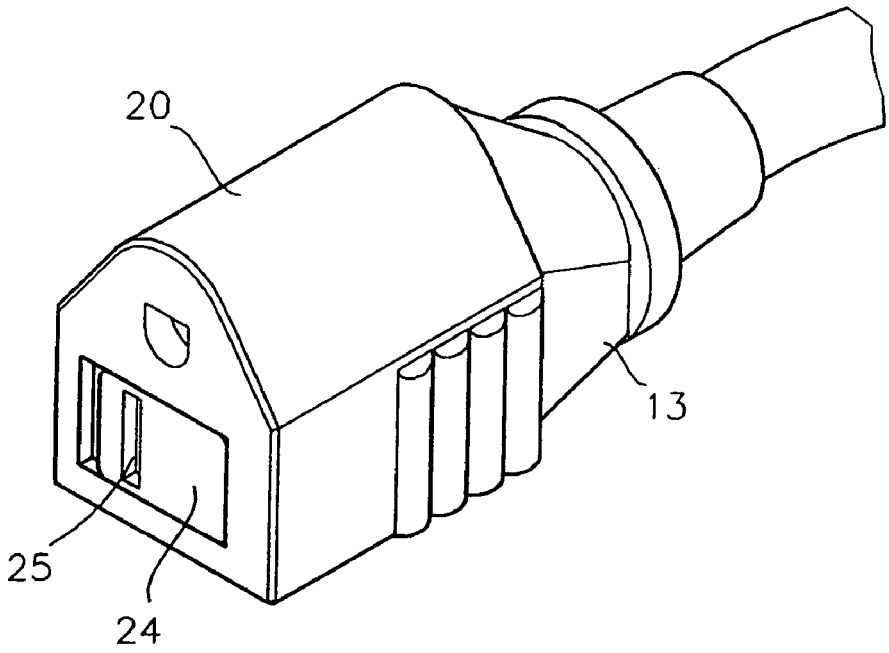
FIG. 2 is a perspective view showing the receptacle of FIG. 1 after it is assembled.
Figure 4:
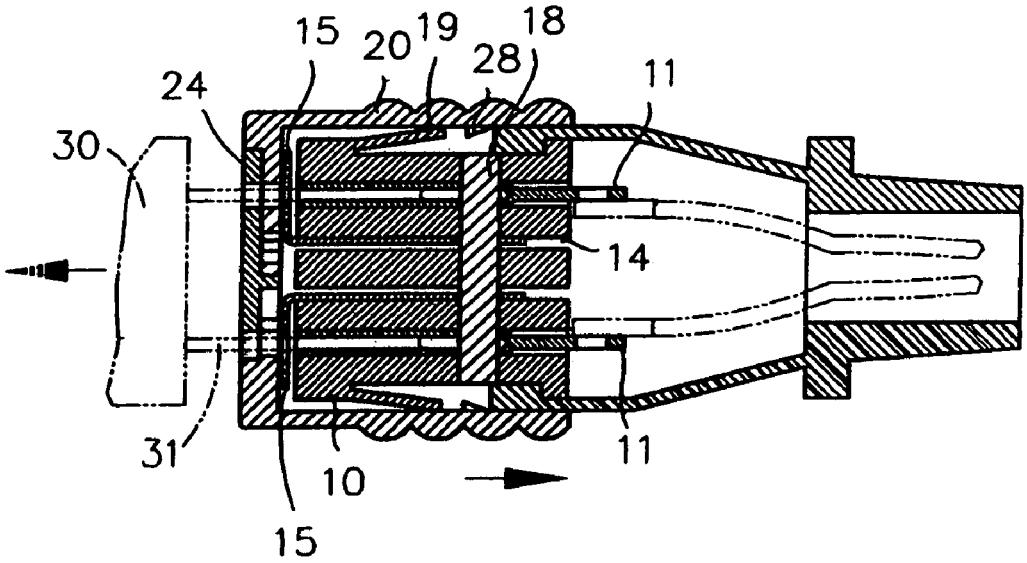
FIG. 4 is a schematic sectional view showing a plug is pulled out from the receptacle of FIG. 1.

Please refer to FIGS. 1 and 4. The present invention provides a unique approach to the conventional receptacle. As illustrated, an embodiment of the receptacle structure provided by the present invention contains a body 10 configured with slots 12 for the installation of electrical conducting blades 11. An end of the body 10 is inserted into a seat 13 which houses the wires for connecting the blades 11 to an electrical power source. On the other end of the body 10, there are additional parallel slots 14 between the slots 12 for the installation of at least a locking blade 15. An end of the locking blade 15 is extended outside of the body 10 and is bended so that a slot opening 16 in the bended portion is roughly aligned with a corresponding slot 12. In some embodiment, only one locking blade 15 is installed while in some other embodiment two locking blades 15 are installed. At the other end of the locking blade 15 which is buried inside the body 10, there is a through hole 17 such that, when the locking blade 15 is inserted into the body 10, a pin 18 could be threaded through or some tenon configured inside the slot 14 could stick into the through hole 17 so as to fix the locking blade 15.

Figure 7:
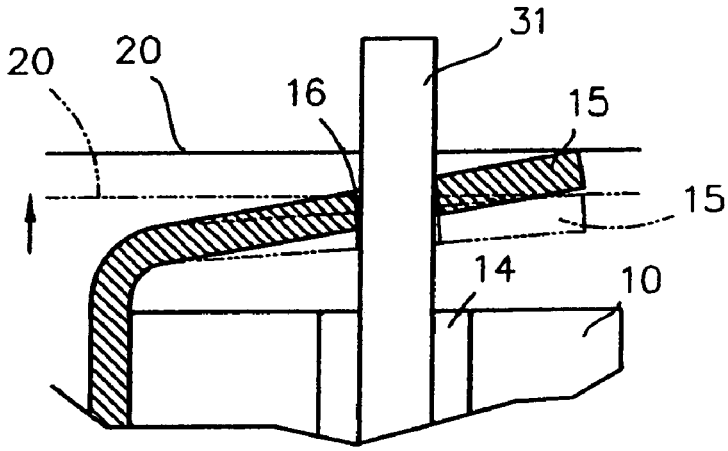
FIG. 7 is a schematic sectional view showing how the bended portion of the locking blade locks a prong.
Figure 3:
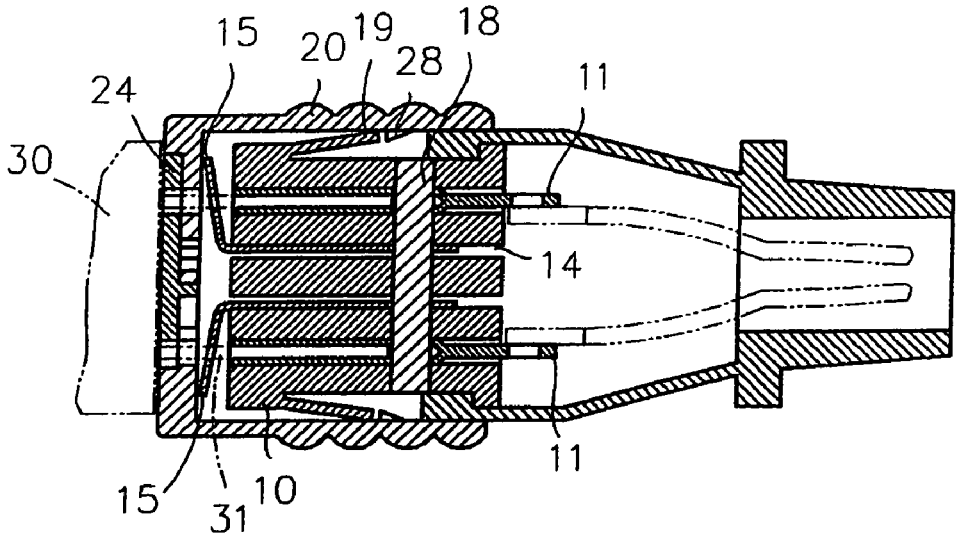
FIG. 3 is a schematic sectional view showing a plug is inserted into the receptacle of FIG. 1.
Figure 5:
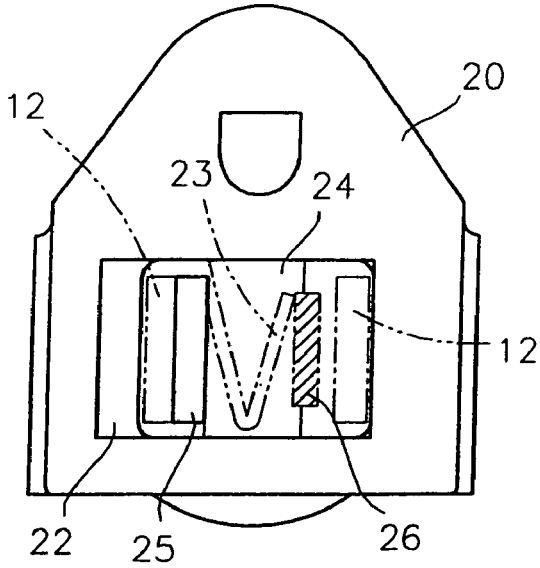
FIG. 5 is a schematic front view showing the receptacle of FIG. 1 when the sliding cover is at its normal position.
Figure 6:
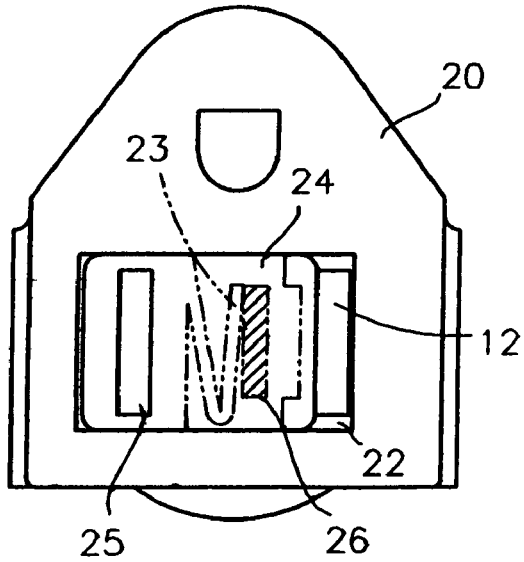
FIG. 6 is a schematic front view showing the receptacle of FIG. 1 when the sliding-cover is pushed aside to reveal the slots.
Figure 8:
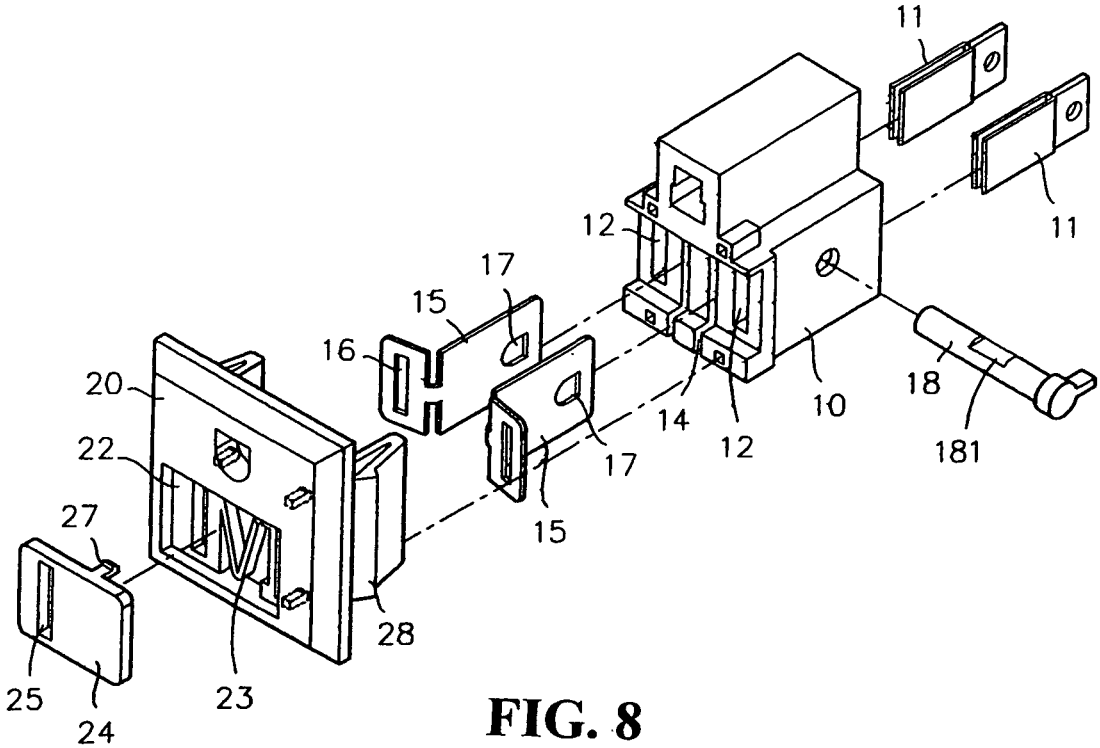
FIG. 8 is a perspective view showing the various components of a receptacle according to another embodiment the present invention.
Figure 9:
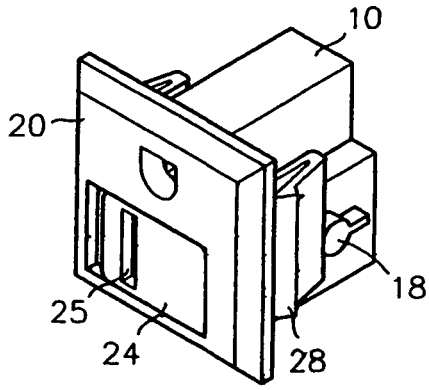
FIG. 9 is a perspective view showing the receptacle of FIG. 8 after it is assembled.
Figure 10:
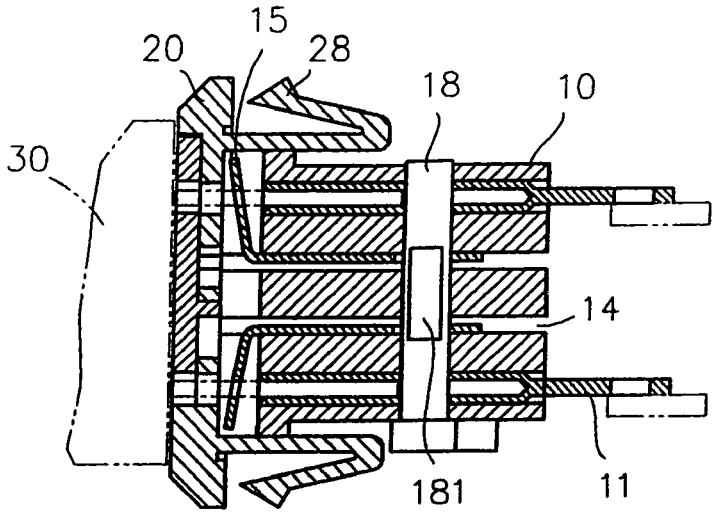
FIG. 10 is a schematic sectional view showing a plug is inserted into the receptacle of FIG. 8.
Figure 11:
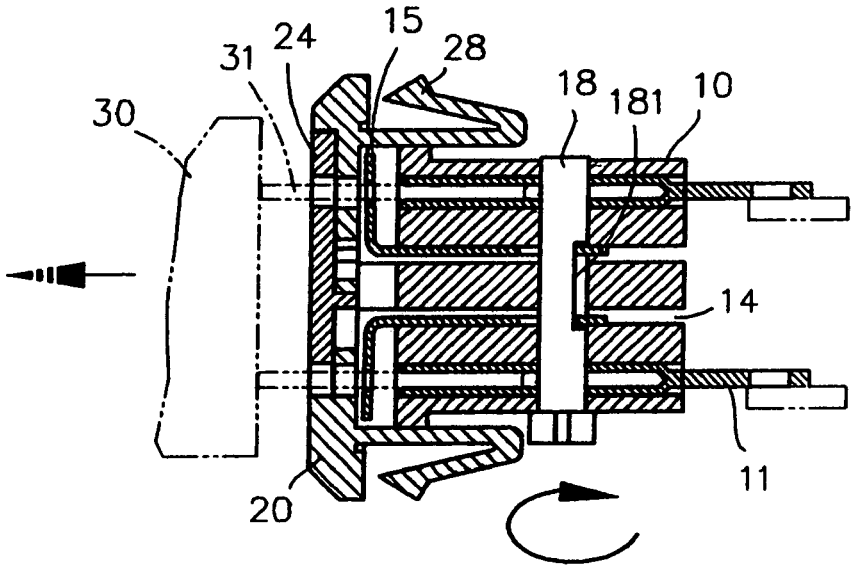
FIG. 11 is a schematic sectional view showing a plug is pulled out from the receptacle of FIG. 8.

Along the two sides the body 10, there are wedges 19 and sliding troughs (not numbered) extended behind the wedges 19 in the direction toward the seat 13. As such, when the body 10 is inserted into an end of a sleeve 20, clasps 28 configured on the inner wall of the sleeve 20 would stop the wedges 19 and thereby prevent the sleeve 20 from being separated from the body 10. On the other hand, the troughs allow the clasps 28 and, therefore, the sleeve 20 to slide back and forth along the troughs. At the other end of the sleeve 20, there is an opening 22 covered by a sliding cover 24. The sliding cover 24 is embedded inside the opening 22 by a protruding clasp 27 at an inner edge of the sliding cover 24. An elastic element 23 is configured inside the sleeve 20 adjacent to the middle section of the opening 22. A vertical flange 26 is configured on the inner side of the sliding cover 24 such that, when the receptacle is not in use, the elastic element 23 presses against the flange 26 and forces the sliding cover 24 to a side to cover both slots 12 for safety. The sliding cover 24 has a vertical slot 25 at an appropriate location such that, when a user uses a prong 31 of a plug 30 to stick into the vertical slot 25 and pushes the sliding cover 24 to the opposite side, a slot 12 is revealed by the sliding cover 24 while the other slot 12 is exposed via the vertical slot 25, as illustrated in FIGS. 5 and 6. The user could then insert the prongs 31 of the plug 30 into the slots 12. When the user pulls out the plug 30, the elastic element 23 forces the sliding cover 24 back to its normal position to cover the slots 12. As shown in FIGS. 3 and 7, when the plug 30 is inserted into the sleeve 20, the sleeve 20 is pushed backward relative the body 10 and the bended portion of the locking blade 15 is pressed against the body 10, making its slot opening 16 completely aligned with a slot 12. A prong 31 then can go all the way into the slot 12 easily through the slot opening 16. After the prong 31 is in its place, the elastic bended portion of the locking blade 15 springs back its slant position which causes the sleeve 20 to return to its normal position and the slot opening 16 to be slightly displaced from the slot 12. The prong 31 is thereby naturally locked by the bended portion of the locking blade 15. As such, the prongs 31 of the plug 30 couldn't be easily separated from the sleeve 20.

To unplug a user first holds the sleeve 20 and then pulls the plug 30 outward. As shown in FIG. 4, the pulling force would drag the body 10 toward the sleeve 20. The slant bended portion of the locking blade 15 is bended further and pressed flatly against the body 10 by the sleeve 20. As such, the slot opening 16 and its corresponding slot 12 are completely aligned, and, without the locking of the slot opening 16, the prong 31 could be removed from the slot 12 easily. When the prongs 31 are completely removed from the slots 12, without the pulling force, the body 10 is returned to its normal position by the elastic force of the locking blades 15 and the bended portions of the locking blades 15 also return to their slant positions. As the displacement of the body 10 is very small, the user usually doesn't feel any difference. Based on the foregoing description, the mechanism provided by the locking blades 15 indeed provides a simple yet reliable locking of the plug 30 to the receptacle of the present invention so as to achieve a safe electrical connection.

In addition to the previous embodiment which is applicable to the receptacle of an ordinary extension wire, the present invention could also be applied to an array of fixed receptacles on an extension device. For this type of application, as illustrated in FIGS. 8~11, the body 10 is configured similarly to the previous embodiment. However, the through holes 17 of the locking blades 15 are configured with a linear edge and, correspondingly, the pin 18 has a sunken middle section 181. As such, when the pin 18 is rotated, the locking blades 15 could be either extended to be pressed by the sleeve 20 to release the prongs 31, or retracted for the bended portions to restore to the slant positions so as to lock the prongs 31. The purpose of this design is that, as a fixed receptacle, a user couldn't hold the sleeve 20 for pulling out the plug 30 and the pin 18 is designed as such to achieve the equivalent locking and releasing effect. For easier installation of the receptacles of the present embodiment into the sockets of an extension device, the sides of the sleeve 20 could be configured with elastic clasps 28. On one hand, the clasps 28 could clip the body 10 and, on the other hand, the clasps 28 could lock to the socket of the extension device. The control of the pin 18 could be extended to the surface of the extension device via an appropriate mechanism (not shown). When the mechanism is engaged, the pin 18 is operated to extend the locking blades 15 to release the prongs 31. And, when the mechanism is disengaged, an elastic element inside the mechanism operates the pin 18 to return the locking blades 15 to their normal position so as to be ready for the next insertion of a plug.

The present invention could be applied to plugs having blade-typed or cylinder-typed prongs. In other words, plugs of various specifications should all be covered by the spirit of the present invention.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A receptacle structure comprising a sleeve and a body inserted into an end of said sleeve, said body having slots for the insertion of prongs of a plug, said slots having electrical conducting blades inside for clipping said prongs, said electrical conducting blades connected to a power source through conducting wires extended from an end of said body opposite to said sleeve, said body having at least a locking blade partially buried inside said body and partially extended toward said sleeve, the extended portion of said locking blade bended to provide spring force against said sleeve, the extended portion of said locking blade having a slot opening that would completely align with a slot of said body when the extended portion of said locking blade is bended entirely against said body, and would displace slightly from said slot when the extended portion of said locking blade returns to a normal slant position;

wherein, when a prong of a plug is inserted into a slot of said body via said sleeve and said slot opening of said locking blade, the pushing force presses the extended portion of said locking blade against said body so that said prong goes all the way into said slot via the completely aligned slot opening; and, when said prong is into said slot, the extended portion of said locking blade springs back to said normal slant position and said slot opening is slightly displaced to lock said prong.

2. The receptacle structure according to claim 1, wherein said body is configured with two said locking blades.

3. The receptacle structure according to claim 1, wherein said locking blade has a through hole on the portion buried inside said body for the penetration of a pin inserted from outside said body so as to fixedly lock said locking blade.

4. The receptacle structure according to claim 1, wherein said locking blade has a through hole on the portion buried inside said body for the penetration of a tenon configured inside said body so as to fixedly lock said locking blade.

5. The receptacle structure according to claim 3, wherein said pin has a sunken middle section.

6. The receptacle structure according to claim 1, wherein said body has at least a wedge configured along a side of said body and a sliding trough extended behind said wedge toward said end of said body opposite to said sleeve; when said body is inserted into said sleeve, a clasp configured on the inner wall of said sleeve stops said wedge and thereby prevents said sleeve from being separated from said body; and said trough allows said clasp and therefore said sleeve to slide back and forth along said trough.

7. The receptacle structure according to claim 1, wherein said sleeve has an opening exposing said slots of said body; said opening is covered by a sliding cover; an elastic element is configured inside said sleeve adjacent to said opening; said elastic element provides elastic sliding of said sliding cover so as to reveal and hide said slots of said body.

8. The receptacle structure according to claim 1, wherein said sleeve has clasps configured along the sides of said sleeve for the locking of said body and for the locking of said sleeve to a socket of an extension device pre-configured with an array of sockets.

9. The receptacle structure according to claim 8, wherein the control of the extension and retraction of said locking blade is extended to the surface of an extension device via an appropriate mechanism; said appropriate mechanism has a built-in elastic element such that, when said mechanism is engaged, said locking blade is extended and pressed by said sleeve against said body to release a plug, and, when said mechanism is disengaged, said elastic element returns said locking blade to said normal slant position so as to be ready for the next insertion of a plug.

* * * * *